US005630763A

United States Patent [19]

Li-Tsan

[11] Patent Number: 5,630,763

[45] Date of Patent: May 20, 1997

[54] GOLF TRAINING BALL

[76] Inventor: Chu Li-Tsan, 2, floor, No. 15-1, Lane 81, Kwuang-Fu S. Rd., Taipei, Taiwan

[21] Appl. No.: 607,812

[22] Filed: Feb. 27, 1996

[51] Int. Cl.[6] ..... A63B 69/36

[52] U.S. Cl. ..... 473/200; 473/280; 273/58 A; 40/327

[58] Field of Search ..... 473/280, 281, 473/200; 273/58 A; 40/327

[56] References Cited

U.S. PATENT DOCUMENTS 1,548,531 8/1925 Knight ..... 473/280 X
1,575,281 3/1926 Rosenberg ..... 473/280 X
2,266,427 12/1941 Hawes ..... 273/58 A

*Primary Examiner*—George J. Marlo
*Attorney, Agent, or Firm*—Beveridge, DeGrandi, Weilacher & Young, L.L.P.

[57] ABSTRACT

A golf training ball comprising at least two cloth stuffed elements each element featuring a sealing point and, stitching to combine the cloth stuffed elements into a unitary ball, where the stuffing comprises a soft fiber, and the cloth elements and stitching are so arranged such that the unitary ball has a core and a periphery with a density gradient between the core and periphery where the golf training ball has a heavier mass in the core and a lesser mass of a soft structure at its periphery to provide a high shock absorbing ability.

4 Claims, 3 Drawing Sheets

GOLF TRAINING BALL

BACKGROUND OF THE INVENTION

Various golf balls for the practice at the places rather than standard golf training courses have been disclosed, and have appeared on the market. FIG. 1 shows a golf training ball according to the prior art. This structure of golf ball is molded from plastic, having a hollow, slotted, spherical body. There is also known another structure of golf training ball which is molded from high-density rubber sponge in a solid state. The conventional golf training balls have various drawbacks as outlined hereinafter:

(1) Short service life. The said hollow, plastic golf training ball have weak structure strength and low shock absorbing ability, and tend to break down upon a heavy strike. The said solid high-density rubber sponge golf training ball tend to break after several hits (about 30 hits on an average).

(2) Low coefficient of safety. When a plastic golf training ball hits a person or an object, the rigid outer shell of the ball will cause a severe damage to the person or the object. The injury will be more serious if the ball is broken. A high-density sponge golf training ball has relatively high density and its shock absorbing ability is still low, therefore it will cause a hurt when hitting or bouncing to hit a person.

(3) High noise. Because regular golf training balls have low shock absorbing ability, they will produce a big noise when hit.

(4) Being pollutive. Regular golf training balls wear quickly with use, and are not reclaimable when damaged. The cost of the disposal of wasted golf training balls is high.

In view of the aforesaid problems, a good golf training ball shall meet the following requirements:

(1) Having a solid structure of proper density. Because regular hollow, plastic golf training balls have a light mass, they do not fly in the track they should have when hit. Regular high-density rubber sponge golf training balls have a heavy mass, and will cause an injury when it hits a person. If to reduce the mass of a solid rubber sponge golf training ball, it tends to be easily deformed and its service life will be relatively shortened.

(2) Having a soft peripheral structure, a density gradually decreased from the center toward the periphery. This arrangement facilitates the practicing of spin, produces low noise when hit, and can buffer the impact force when the ball hits a person or an object.

(3) Being durable and repairable. Using durable golf training balls greatly saves the training cost, and reduces the possibility of polluting the environment.

SUMMARY OF THE INVENTION

The present invention has been accomplished under the circumstances in view. It is one object of the present invention to provide a golf training ball which is suitable for the practice of hitting indoors in a narrow space against a wall, window, curtain, certain target and etc. It is another object of the present invention to provide a golf training ball which has a high shock absorbing ability and does not cause an injury when hitting a person or an object. It is still another object of the present invention to provide a golf training ball which is practical in use and can be positively driven to fly in the directed course and to rotate in the directed direction. It is still another object of the present invention to provide a golf training ball which produces low noise when hit. It is still another object of the present invention to provide a golf training ball which is durable in use, and does not deform after for example two hundred of hits. It is still another object of the present invention to provide a golf training ball which can be easily repaired by the user when damaged. It is still another object of the present invention to provide a golf training ball which is less pollutive.

According to one aspect of the present invention, the golf training ball has a density gradually and equally reducing from the center toward the periphery. The high mass of the center helps the ball from not being deformed and also helps the ball being steady when hit and flies. The soft feature of outer shell helps the ball having high shock ability in order to not hurt a person or an object when miss hitting.

According to another aspect of the present invention, the golf training ball is formed by combining two fiber-stuffed cloth balls (shaped like a chinese stuffed bun) into one ball by means of stitches. And the combining area is the heavy end of the said two balls.

DETAILED DESCRIPTION OF THE PREFERRED EMBODIMENT

Reffering to FIGS. 2, 3, 4, and 5A, a golf training ball in accordance with the present invention is made by combining two fiber-stuffed cloth balls 1A, 1B into a ball.

The fiber-stuffed cloth balls 1A, 1B are made by putting proper quantity of stuffing member 2A, 2B inside the round cloth and have round cloth's margin gathered and sealed by means of stitches with a thread 4 at the point 3. The point 3 becomes the biggest density area of the balls 1A, 1B. The stuffing members 2A, 2B are made from polyester fibers, which enables the periphery of the balls 1A, 1B having soft feature.

Then, we let two fiber-stuffed cloth balls 1A, 1B pushed to be combined to form a round ball from their point 3 to point 3. And then a thread 4 is used to stitch and fix the two bails 1A, 1B into a round golf training ball along the margin of connecting face of the two fiber-stuffed cloth ball 1A, 1B.

When the golf training ball is made, the density is gradually and equally reduced from the center toward the outer shell. The fiber-stuffed cloth balls 1A, 1B may be connected each other by a bonding agent at the face of points 3, which will help the maker to fix the two balls into a golf training ball. A mold having a semispherical cavity may be used for making the fiber-stuffed balls 1A, 1B. Furthermore, the two fiber-stuffed cloth balls 1A, 1B may have different colors (see also FIG. 5A).

Figure 1:
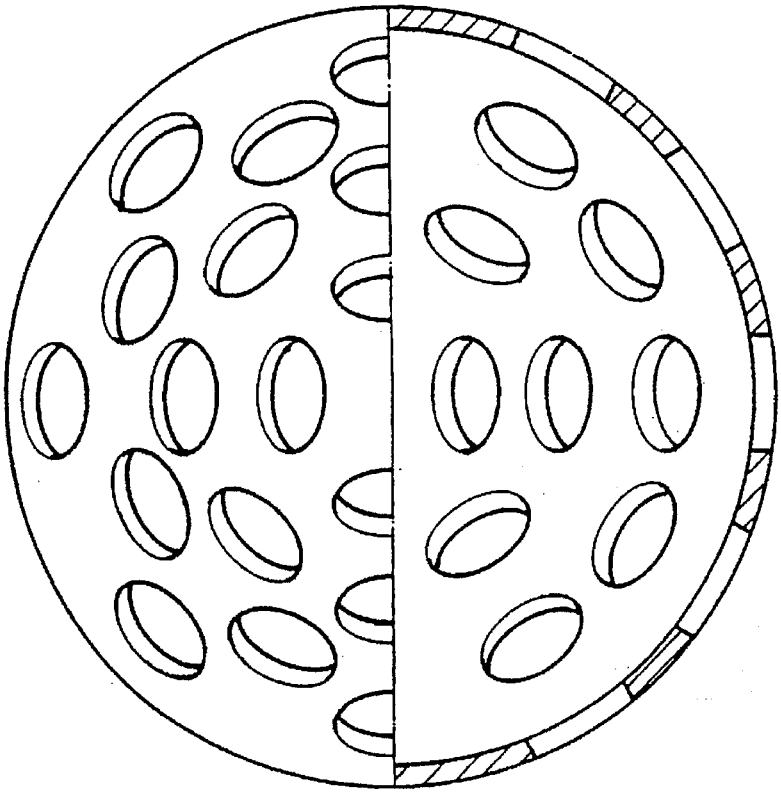
FIG. 1 PRIOR ART
FIG. 1 shows a hollow, plastic golf training ball according to the prior art.
Figure 2:
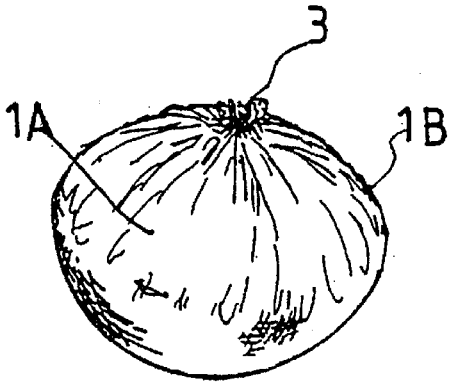
FIG. 2 shows a fiber-stuffed cloth ball on which the biggest density is on the gathering end (sealing end)
Figure 3:
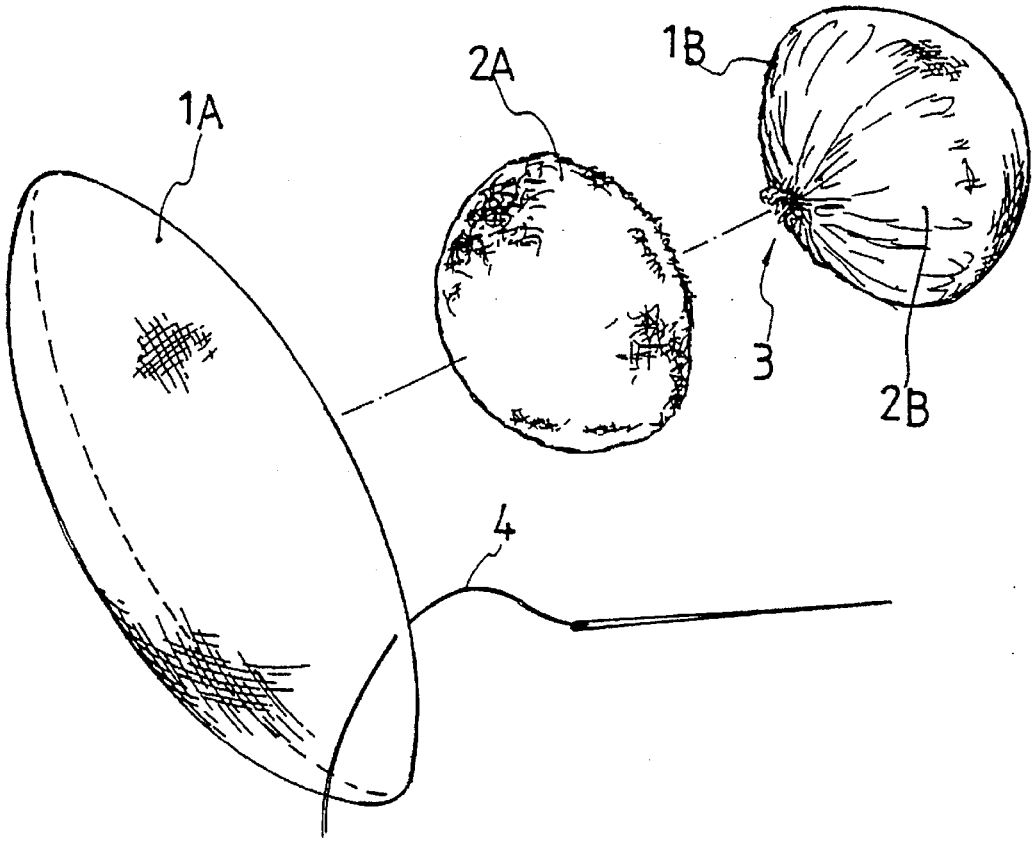
FIG. 3 is an exploded view of a golf training ball according to the present invention.
Figure 4:
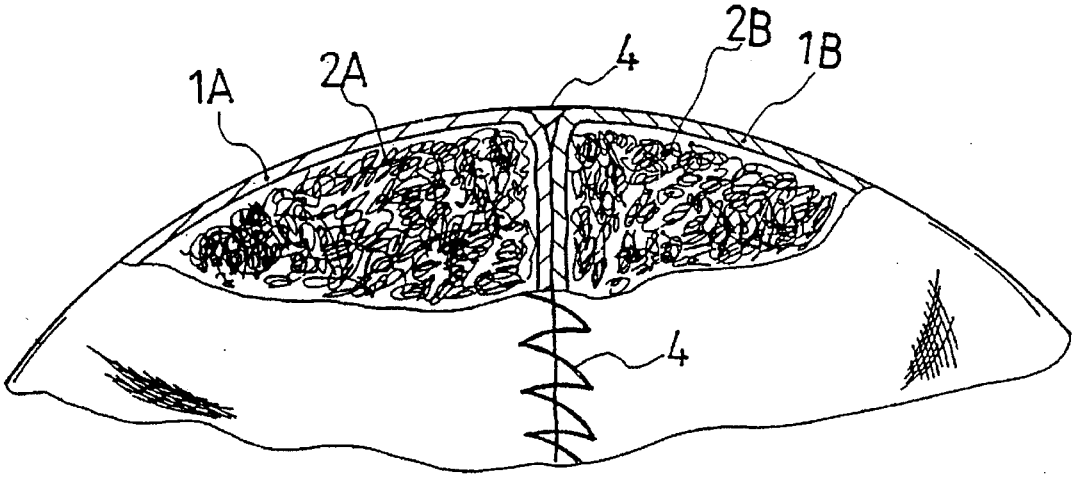
FIG. 4 is a partial view in section in an enlarged scale of the golf training ball according to the present invention.
Figure 5A:
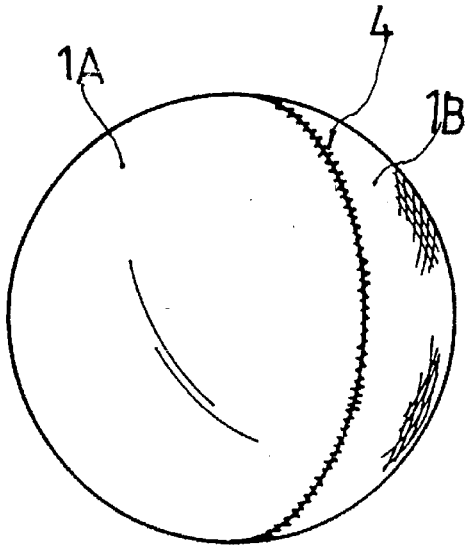
FIG. 5A shows a golf training ball which is formed by combining two fiber-stuffed cloth balls which are of different colors on cloth. This helps the user to find out training ball's rotation direction after hitting.
Figure 5B:
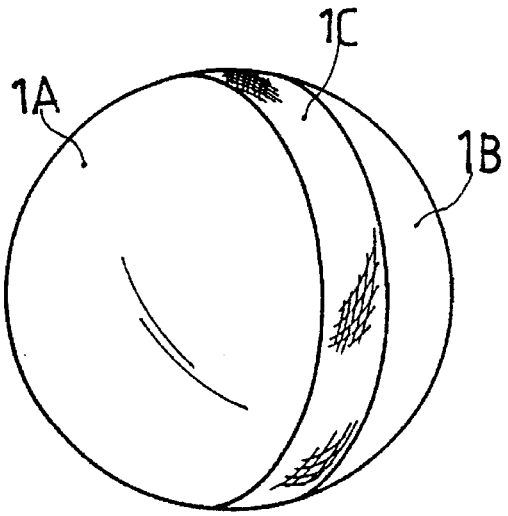
FIG. 5B shows a golf training ball which is formed by combining two fiber-stuffed cloth balls which are of the same color on cloth. And a different colored cloth collar is covered on the connecting are a of the two said cloth balls in order to protect the stitches and also help the user to find out ball's rotation direction after hitting.

As an alternate form of the present invention, the two fiber-stuffed cloth balls 1A, 1B have the same color, and a cloth collar 1C having a different color is covered over the stitches 4 (see also FIG. 5B) by means of stitches.

It is to be understood that the drawings are designed for purpose of illustration only, and are not intended as a definition of the limits and scope of the invention disclosed.

What is claimed is:

1. A golf training ball comprising at least two cloth stuffed elements each element featuring a sealing point and, stitching to combine the cloth stuffed elements into a unitary ball, where the stuffing comprises a soft fiber, and the cloth elements and stitching are so arranged such that the unitary ball has a core and a periphery with a density gradient between the core and periphery where the golf training ball has a heavier mass in the core and a lesser mass of a soft structure at its periphery to provide a high shock absorbing ability.

2. The golf training ball of claim 1 wherein said stuffed elements include polyester fiber.

3. The golf training ball of claim 1 wherein each cloth stuffed element is semi-spherical and features a cloth shell where the cloth shell of each cloth stuffed element is a different color.

4. The golf training ball of claim 1 wherein each stuffed element is semi-spherical and includes a cloth shell and a cloth collar having a different color from the color of said cloth shells covers the stitching.

* * * * *